United States Patent [19]

Inoue

[11] Patent Number: 5,056,723

[45] Date of Patent: Oct. 15, 1991

[54] AUTOMATIC WINDER

[75] Inventor: Kazuyuki Inoue, Kyoto, Japan

[73] Assignee: Murata Kikai Kabushiki Kaisha, Kyoto, Japan

[21] Appl. No.: 493,007

[22] Filed: Mar. 12, 1990

[30] Foreign Application Priority Data

Mar. 13, 1989 [JP] Japan ..... 1-61149

[51] Int. Cl.[5] ..... B65H 54/02

[52] U.S. Cl. ..... 242/18 EW

[58] Field of Search ..... 242/18 EW, 18 PW, 18 R, 242/35.5 A, 35.5 R, 35.6 R

[56] References Cited

U.S. PATENT DOCUMENTS 4,736,898 4/1988 Raasch et al. ..... 242/18 EW

*Primary Examiner*—Stanley N. Gilreath

*Attorney, Agent, or Firm*—Spensley, Horn, Jubas & Lubitz

[57] ABSTRACT

There is provided a restriction guide for guiding and restricting yarn at the winding end of a package which yarn has been guided to a falling position and then fallen from an end face of the package, to a predetermined position of a bobbin.

7 Claims, 6 Drawing Sheets

AUTOMATIC WINDER

FIELD OF THE INVENTION

The present invention relates to an automatic winder and particularly to a bunching mechanism for a package.

RELATED ART STATEMENT

A package formed by an automatic winder is subjected to bunching at the winding end so that the yarn thereon can be drawn out easily in the next step. More particularly, at the end of winding, a yarn end is wound round a bobbin end located on the yarn draw-out side in the next step.

In winding a yarn end round a bobbin T1 or T2 of a cheese package P1 or a cone package P2 shown in FIGS. 14 and 15, the yarn extending from the yarn feed side is moved outside the traverse range by means of a movable guide and is allowed to fall from an end face of the package, then in this state the package P1 or P2 is rotated several times in the winding direction, whereby a bunch winding is formed on the bobbin easily.

However, for example in such a cone package P3 as shown in FIG. 16, when an end face T3*a* of a bobbin T3 is positioned inside an outer peripheral edge P1*a* of the yarn layer of the package, the yarn will not be wound round the bobbin T3 even if it is guided to the left beyond the edge P1*a* and then allowed to fall from the package end face.

OBJECT AND SUMMARY OF THE INVENTION

It is an object of the present invention to provide a bunching mechanism capable of making bunching for a package in which bunching was previously not possible as mentioned above.

In the present invention there is provided a restriction guide for guiding and restricting yarn at the winding end of a package. The yarn is guided to a falling position and then falls from an end face on the package, to a predetermined position of a bobbin.

DETAILED DESCRIPTION OF PREFERRED EMBODIMENT

An embodiment of the present invention will be described hereinunder with reference to the drawings.

Figure 1:
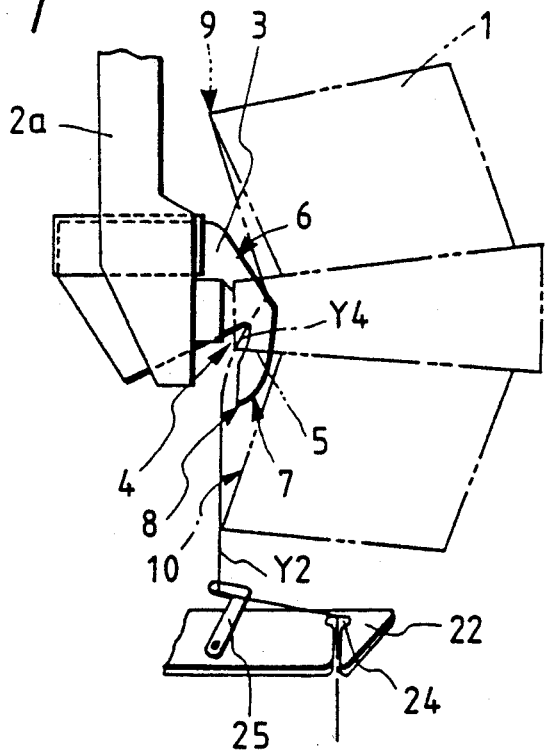
FIG. 1 is a perspective view of a principal portion showing an embodiment of the present invention.
Figure 2:
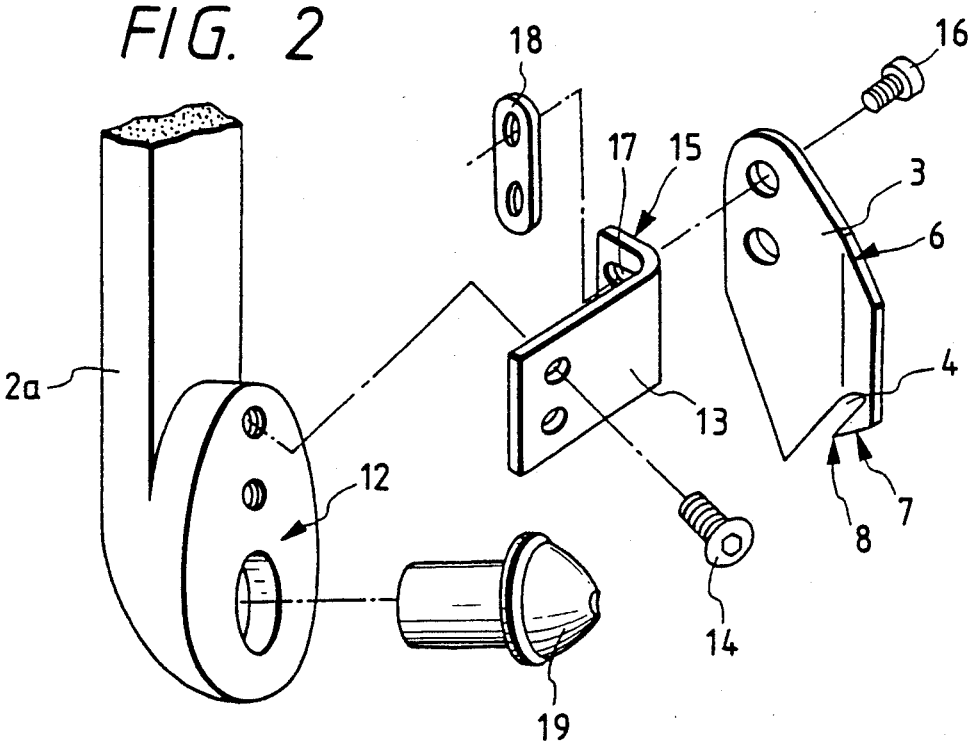
FIG. 2 is an exploded explanatory view showing a method of mounting a bunching restriction guide 3 to a cradle.

In FIGS. 1 to 4, a bunching restriction guide 3 shown in FIGS. 1 and 2 is fixed in a predetermined position of a cradle portion 2*a* located on a package smaller-diameter side of a double-side supported cradle 2 which supports a package 1. The guide 3 has a slot 4 for picking up and positioning yarn lying on the yarn feed side and also has first and second inclined guide surfaces 6, 7 for moving yarn portion extending between the slot 4 and the package surface onto a bobbin 5. A tip portion 8 of the guide contiguous to the slot 4 is located in a position at least closer to an end face 10 of the yarn layer than to an outer peripheral edge 9 of the yarn layer, so that the yarn falling from the package end face enters the slot 4 naturally along a later-described movable guide.

Figure 3:
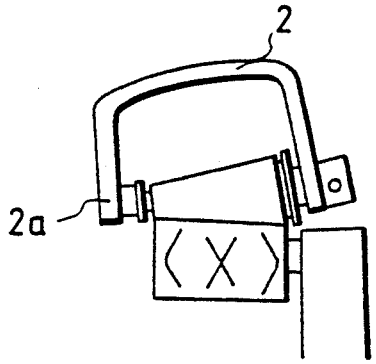
FIG. 3 is a front view of a cradle portion of an automatic winder.
Figure 4:
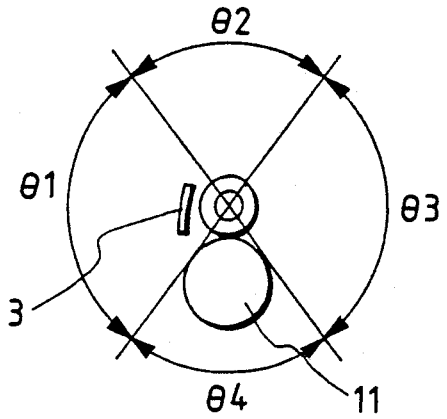
FIG. 4 is an explanatory view of a guide 3 mounting position.

The mounting position of the guide 3 to the cradle is set in a certain range $\theta_1$ shown in FIGS. 3 and 4. More specifically, out of ranges $\theta_1$ and $\theta_3$ except a certain range $\theta_4$ of a traverse drum 11 and a range $\theta_2$ which serves as a feed path for a new bobbin at the time of doffing, the range $\theta_3$ on the front side of a winding unit, namely on the yarn travelling side, does not permit bunching in effect, so the guide 3 is disposed in the range $\theta_1$ which permits bunching without obstacle to the doffing behind the winding unit. Therefore, if FIG. 1 is a front view as seen from the front side of the winding unit, the guide 3 is positioned behind the bobbin 5.

The mounting of the guide 3 is performed like FIG. 2 for example. As shown therein, an L-shaped mounting piece 13 is fixed with bolts 14 to a package supporting-side end face 12 of the cradle portion 2*a*, then the bunching restriction guide 3 is fixed to a mounting surface 15 of the mounting piece 13 using bolts 16 and a nut piece 18. The position of the guide 3 can be adjusted through an elongated hole 17 of the mounting piece 13 to let the tip portion 8 of the guide slot 4 assume a predetermined position. The numeral 19 denotes a support member for the bobbin.

The following description is now provided about the bunching operation performed by the bunching guide described above.

Figure 5:
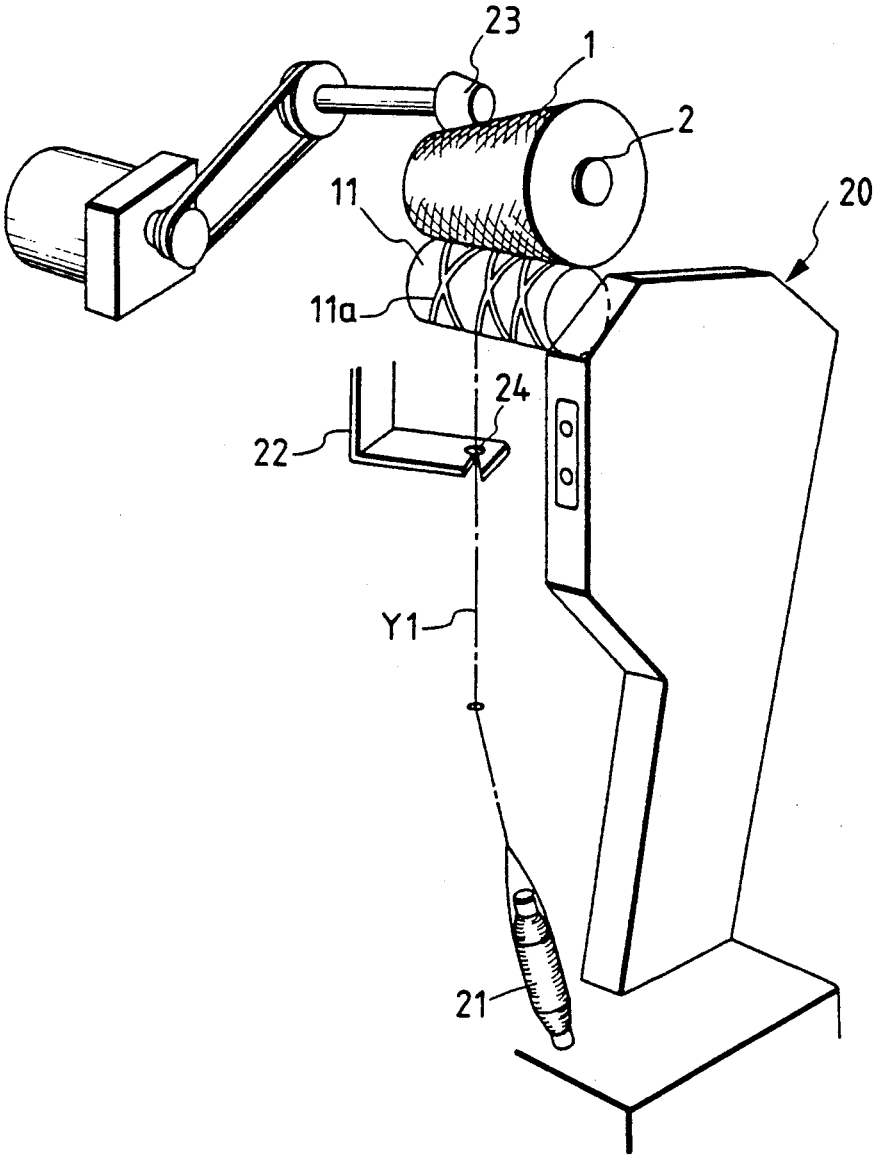
FIG. 5 is a perspective view showing an initial state in a doffing operation.

As shown in FIG. 5, the package 1 formed by the automatic winder 20 is subjected to doffing by means of an auto doffer (hereinafter referred to simply as "AD") (not shown) and replaced with an empty paper spool or bobbin. In this case, in order to catch yarn Y1 extending from a winding-start feed bobbin 21, an L-shaped lever 22 which is a conventional one provided in the AD goes down while moving pivotally. Next, a package rotating roller 23 provided in the AD rotates so as to contact the package 1, so that the package rotates in the winding direction, whereby the yarn Y1 is conducted into a traverse groove 11*a* and thereby conducted and caught in a yarn guide slot 24 formed in the L-shaped lever 22.

In this embodiment, moreover, a pivotable lever 25 for hooking and guiding the yarn Y1 is provided on the L-shaped lever 22, as shown in FIG. 1, and it is turned up to a position in which yarn Y2 located between the package 1 and the guide slot 24 falls from the end face on the smaller diameter side of the package. Various devices are adoptable for actuating the lever 25.

Figure 6:
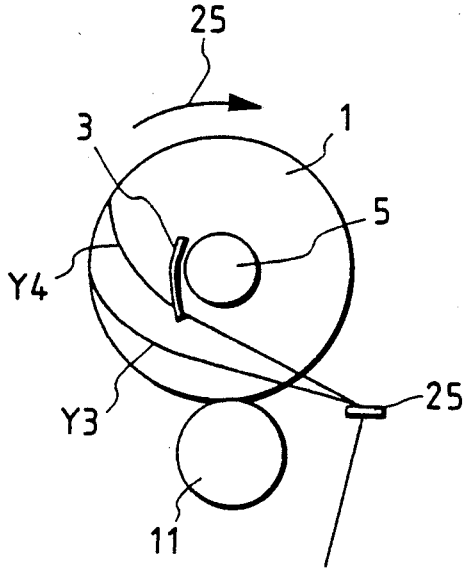
FIG. 6 is a side view showing a travelling path of yarn which has fallen from a package end face.

The yarn which has fallen from the package end face travels along a yarn path Y3, as shown in FIG. 6. Then, when the package 1 is rotated in the direction of arrow 25 in FIG. 6, it rotates in the yarn winding direction, so yarn is drawn out from the feed bobbin side without unwinding of yarn from the package. With the rotation of the package, the yarn travels along a yarn path Y4 shown in FIG. 6 and the yarn, now Y4, enters the slot 4 of the bunching guide 3.

Figure 7:
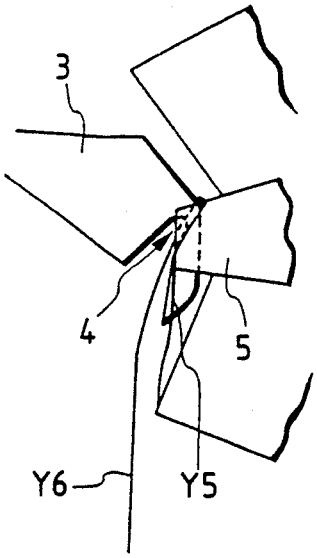
FIGS. 7 to 13 are explanatory views showing bunching steps using the guide 3.
Figure 8:
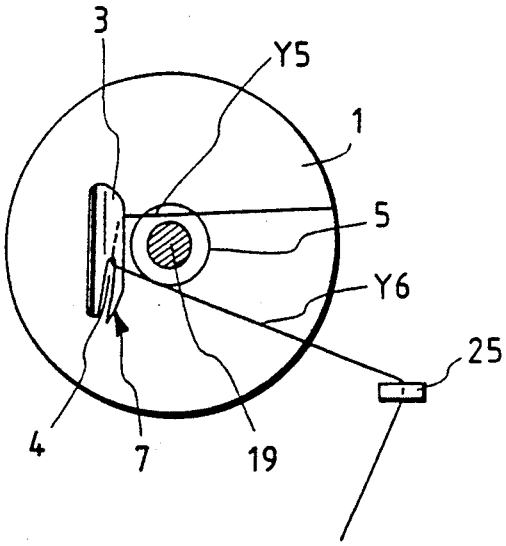

As the package 1 further rotates, the yarn is caught in the slot 4 and is guided by the first guide surface 6. With further rotation of the package, the yarn is disengaged from the bobbin 5 due to the taper of the bobbin 5 (FIGS. 7 and 8). Then, the yarn, now indicated at Y5, gets on the bobbin support member 19 of the cradle as in FIG. 8. At this time, the yarn, indicated at Y6, on the yarn feed side is kept engaged in the slot 4 of the guide 3.

Figure 9:
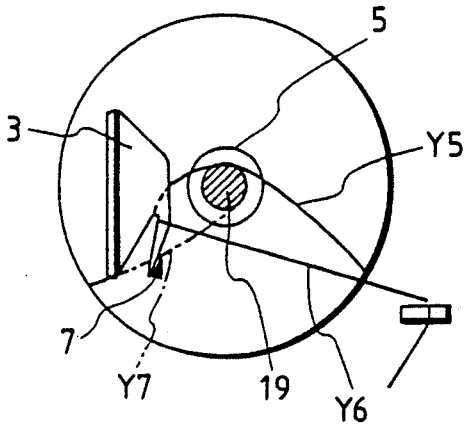
Figure 10:
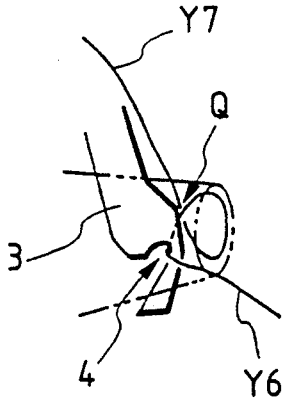
Figure 11:
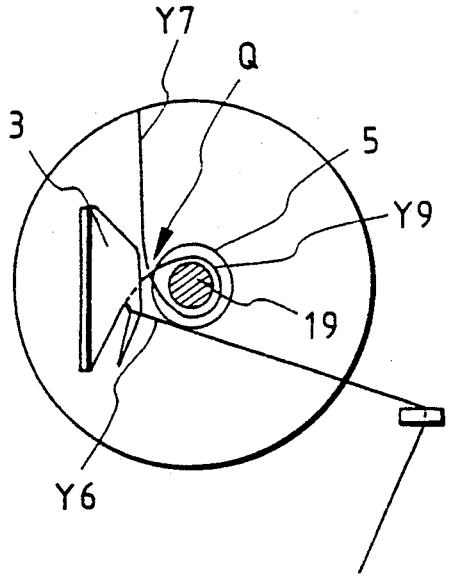
Figure 12:
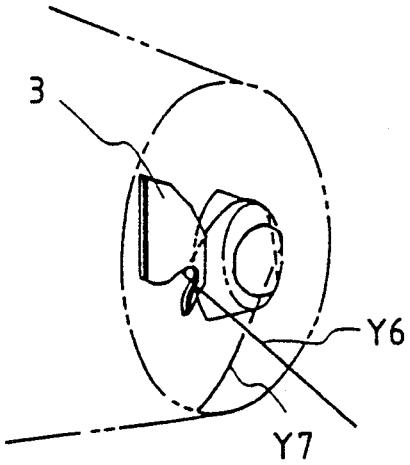

As the package further rotates, the yarn which has fallen from the package end face moves from the yarn path Y5 to a yarn path Y7 in FIG. 9. In this case, the yarn, indicated at Y7, on the package side is guided to the bobbin side by the second guide surface 7 of the guide 3. With further rotation of the package, the yarn Y6 being wound up intersects the package-side yarn Y7 at Q in upper and lower relation to each other, as shown in FIGS. 10 and 11. By the resulting friction force, the yarn being wound up can be prevented from being disengaged from the bobbin.

Figure 13:
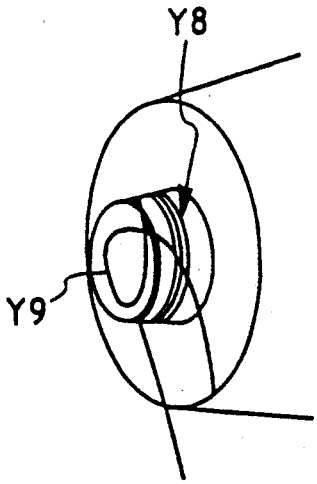
Figure 14:
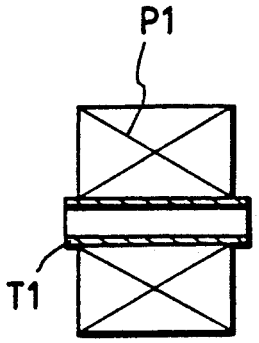
FIGS. 14 to 16 are sectional front views showing several kinds of take-up packages.
Figure 15:
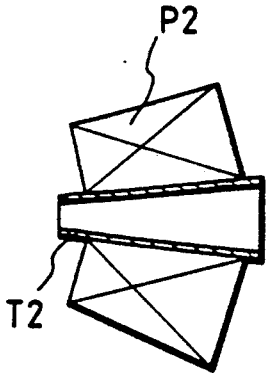
Figure 16:
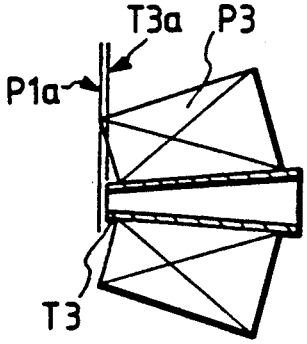

When the package is further rotated, the yarn Y6 being wound up is taken up onto the bobbin 5 while its movement is restricted by the slot 4, whereby there is formed such a bunch winding Y8 as shown in FIG. 13.

The numeral Y9 denotes a single yarn which has fallen onto the support member 19 and which is present even after doffing. When the bunch winding has been formed in a predetermined amount, the yarn extending between the package and the feed bobbin is cut in a predetermined position and there is performed a conventional doffing operation.

Although in the above embodiment the bunching restriction guide 3 is fixed to the cradle arm, there may be adopted a construction in which the guide 3 is provided on the AD side and it is moved up to the position shown in the above embodiment when required, then when the bunching operation is over, the guide 3 is moved back into the AD body.

According to the present invention, as set forth hereinbefore, even in a cone package wherein the end face of a bobbin on the smaller-diameter side of the cone package is positioned inside the outer peripheral edge of the package yarn layer, it is possible to form a bunch winding on the bobbin in a predetermined position.

What is claimed is:

1. In an automatic winder for winding yarn onto a bobbin to form a package, a restriction guide for guiding and restricting yarn which has been guided to and is displaced from an end face of the package to a bunching position of a bobbin, the restriction guide comprising:

a member having a slot for picking up and positioning the yarn which has been displaced from the end face of the package, first and second inclined guide surfaces for moving a portion of the yarn extending between the slot and a surface of the package onto the bobbin, and a tip portion contiguous to the slot and located in a position closer to an end face of the yarn package than to an outer peripheral edge of the yarn package, the tip portion enabling the yarn to enter the slot of the member.

2. The restriction guide according to claim 1, wherein said automatic winder includes a cradle which supports the package, and wherein the restriction guide is disposed on the cradle in a position which permits bunching and doffing of the package.

3. The automatic winder according to claim 2, wherein said restriction guide is adjustably disposed on a package supporting-side end face of the cradle, the restriction guide being adjustable so as to enable the tip portion to assume a predetermined position.

4. A restriction guide comprising:

means for picking up and positioning a yarn which has been displaced from an end face of a yarn package, means for moving a portion of the yarn onto a bobbin, the portion extending between the means for picking up and positioning and a surface of the package, and means, disposed in a position closer to an end face of the yarn package than to an outer peripheral edge of the yarn package, for enabling the displaced yarn to be positioned in proximity to the means for picking up and positioning.

5. A restriction guide according to claim 4, wherein the means for picking up and positioning comprises a slotted member.

6. A restriction guide according to claim 5, wherein the means for moving comprises first and second inclined surfaces disposed on the slotted member.

7. A restriction guide according to claim 6, wherein the means for enabling comprises a tip portion contiguous to a slot in the slotted member, the tip portion enabling the yarn to enter the slot of the slotted member.

* * * * *